United States Patent [19]

Perkins

[11] 4,215,784

[45] Aug. 5, 1980

[54] WALL BRACKET ASSEMBLY

[76] Inventor: Patrick W. Perkins, 8015 Wentworth St., Sunland, Calif. 91040

[21] Appl. No.: 5,007

[22] Filed: Jan. 22, 1979

[51] Int. Cl.[2] ..... A47F 5/08

[52] U.S. Cl. ..... 211/105.2; 211/123; 248/241; 248/298

[58] Field of Search ..... 211/105.1, 123, 182, 211/105.2, 204, 193; 108/108; 248/241, 298

[56] References Cited

U.S. PATENT DOCUMENTS

| | | | |
|---|---|---|---|
| 3,286,850 | 11/1966 | Ruhnke | 211/105.1 |
| 3,322,288 | 5/1967 | Mayer | 211/193 |
| 3,664,511 | 5/1972 | Fenwick | 211/105.1 |
| 3,679,067 | 7/1972 | Konstant | 211/182 |
| 3,747,885 | 7/1973 | Ciancimino | 211/182 X |
| 3,990,582 | 11/1976 | Schindel | 211/105.1 |

*Primary Examiner*—Roy D. Frazier
*Assistant Examiner*—Robert W. Gibson, Jr.
*Attorney, Agent, or Firm*—John J. Posta, Jr.

[57] ABSTRACT

The improved wall bracket assembly of the present invention comprises, in combination, a plurality (preferably two) of spaced, generally parallel, preferably vertical locator strips, each having spaced bracket-receiving holes along the length thereof, and a horizontal cross support spanning the strips and having a plurality of bracket-receiving hollow rear extensions each extension is disposed near a separate one of the strips and includes a pair of spaced sidewalls. The assembly also includes a plurality of brackets, the front end of each bracket being releasably disposed within a separate one of the extensions and the rear end of each bracket being releasably disposed in a separate one of the strip holes. Bracket adjusting and locking means are provided in the form of spaced threaded holes in the bracket front end, at least one opening in each extension sidewall and threadably received through the bracket holes to enable the bracket to be variable positioned relative to the extension sidewalls and to be locked in place by the bolts. Preferably, there are at least two spaced openings and bolts in one sidewall of each extension. With this arrangement, the cross support can be easily placed in position by means of the brackets, at various locations along the length of the locator strips, even if the locator strips are not truly parallel with each other. All that need be done is to loosen the bracket-adjusting bolts, connect the brackets to the locator strips and tighten the bolts. Accordingly, the assembly is inexpensive, simple and rapid to use and easily adjusted, as desired.

8 Claims, 8 Drawing Figures

WALL BRACKET ASSEMBLY

BACKGROUND OF THE INVENTION

1. Field of the Invention

The present invention generally relates to wall hangings and more particularly to wall bracket assemblies of an improved type.

2. Prior Art

When it is desired to install a crossbar, garment rack, storage shelf or the like on a wall, particularly when it is desired that the crossbar, rack or shelf be easily repositionable on the wall, resort is frequently made to narrow spaced vertical locator strips. Such strips usually bear openings, such as holes or pockets along their length, into which support brackets may be inserted at various heights on the wall. The crossbar, rack, or shelf usually is connected to a pair of the brackets before inserting the brackets into the locator strips. In many instances, the brackets are integral with the cross support. If the center to center spacing between the brackets is not exactly duplicated by the spacing (center to center) between the locator strips, both brackets cannot be inserted into the pair of strips. Instead, expensive, time consuming and messy strip remounting must take place or one or both of the brackets must be bent. Even if the spacing between the locator strips at a given height is correct, there will be a problem of reconnecting the brackets to the strips when it is desired to reposition the bar, rack or shelf at a different height on the wall, if the locator strips are not precisely parallel along their length.

Accordingly, there is a need for improvements in wall bracket assemblies which will permit such brackets to be more easily connected to locator strips and repositioned along the length of the strips, as desired, even through the strips may not be precisely parallel with each other.

SUMMARY OF THE INVENTION

The improved wall bracket assembly of the present invention satisfies the foregoing needs. Thus, in addition to a plurality of locator strips, brackets releasably connected at their rear ends to the strips, and a cross support spanning the strips and connected through holes rearwardly directed hollow extensions to the front ends of the brackets, it includes bracket-adjusting and locking means. The bracket-adjusting and locking means permit the brackets to be easily adjusted to the correct distance from each other in order to precisely and correctly connect to the locator strips along their length, even if the locator strips are not parallel with each other. Moreover, the brackets can be locked in place easily.

The bracket-adjusting and locking means include at least one opening in each sidewall of each hollow extension, at least two threaded holes in the bracket front end alignable with said sidewall openings, and threaded bolts or the like slideably received through the sidewall openings and threadably received through said threaded holes. The openings are out of alignment with each other. Preferably, one of each pair of sidewalls has at least two spaced openings and each bracket front end has at least three spaced threaded holes alignable with all the sidewall openings. By manipulating (rotating) the bolts, the bracket intercepted by the bolts can be moved internally of the extension to reposition it as desired relative to the sidewalls. The bolts can also be used to lock the bracket in the desired position in the extension. The assembly can be made inexpensively and is simple and highly effective. Further features are set forth in the following detailed description and accompanying drawings.

DRAWINGS

DETAILED DESCRIPTION

FIGS. 1, 2, 4, 5, 6, 7 and 8

Figure 1:
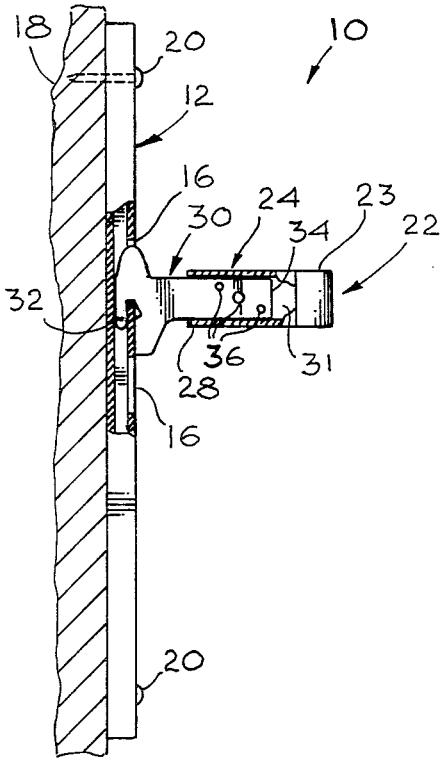
FIG. 1 is a schematic side elevation, partly broken away, of a first preferred embodiment of the improved wall bracket assembly of the present invention mounted on a wall.
Figure 2:
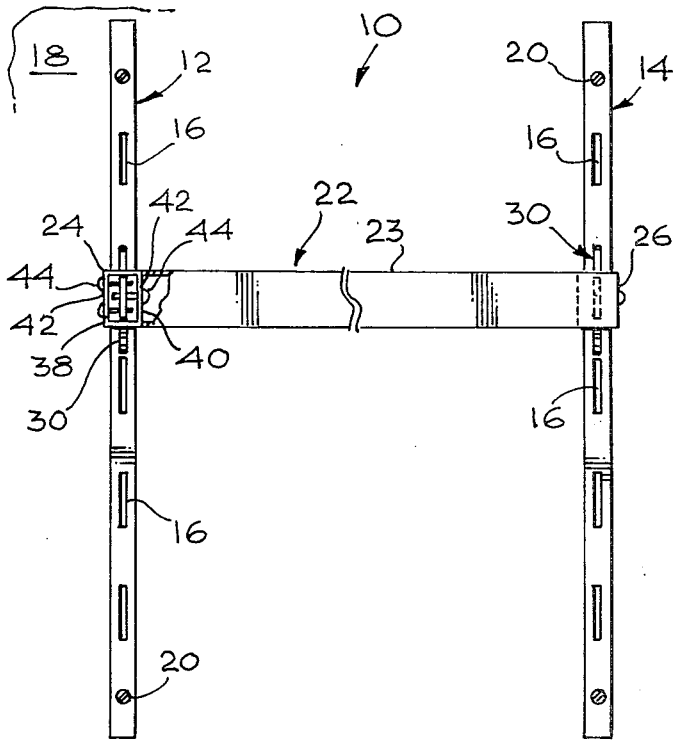
FIG. 2 is a schematic front elevation, partly broken away, of the bracket assembly of FIG. 1.

Now referring more particularly to FIGS. 1 and 2 of the accompanying drawings, a first preferred embodiment of the improved wall bracket assembly of the present invention is schematically depicted therein. Thus, assembly 10 is shown, which comprises, in combination, a spaced pair of narrow, vertically extending generally parallel locator strips 12 and 14, each having a plurality of vertically spaced recesses or apertures 16 disposed therein along the length thereof. Strips 12 and 14 are secured to a wall 18, as by nails 20, or adhesive or the like.

Assembly 10 also includes a generally U-shaped (in plan view) cross member 22 in the form of a horizontal bar 23 spanning strips 12 and 14 and having an integral pair or rearwardly extending extensions 24 and 26 at opposite ends thereof. Bar 23 and extensions 24 and 26 may be of any suitable construction, size and shape, for example, they may be rectangular, in vertical cross section and extensions 24 and 26 are also hollow and open at their rear ends 28.

A separate elongated bracket 30 is releasably secured within the hollow interior 31 of each extension 24 and 26, and extends rearwardly thereof into releasable connection with one of strips 12 and 14 in order to hold assembly 10 in place against wall 18. For this purpose, bracket 30 preferably is a generally vertical plate which includes a protruding and depending rear hook 32. Bracket 30 can be slid down against strip 12 or 14 until hook 32 is releasably received within and secured to an aperture 16, as shown in FIG. 1. In this position bracket 30 is braced against and support against the strip 12 or 14. Bracket 30 can be released at any time from strip 12 or 14 by lifting bracket 30 until hook 32 is removed from aperture 16. Bracket 30 can also be positioned and repositioned at any desired level of the wall by selecting the desired aperture 16 with which to engage hook 32.

In order for both hooks 32 (one per bracket 30) to be able to engage any given pair of apertures 16 at the same level on both strips 12 and 14, brackets 30 must have the same center to center spacing as those two apertures 16. In order to assure that this will occur, extensions 24 and 26 are made wide, relative to the thickness of brackets 30 and special bracket-adjusting and locking means are provided. Thus, the front end 34 of each bracket 30 is provided with three spaced threaded holes 36 and opposite sidewalls 38 and 40 of each extension 24 and 26 bear unthreaded openings 42, sidewall 38 having two openings 42 and sidewall 40 having one opening 42, through which are slideably received threaded bolts 44. Holes 36 are simultaneously alignable with all openings 42. Bolts 44 are threadably received through holes 36 to hold bracket 30 in place in interior 31.

Figure 4:
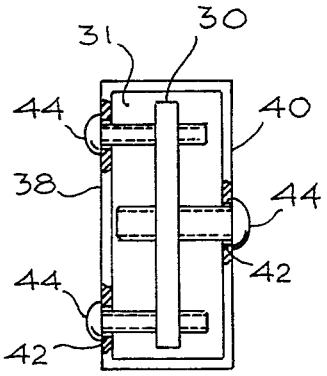
FIG. 4 is an enlarged schematic fragmentary cross-section of the bracket-adjusting and locking means of FIG. 2 in a locked first position.
Figure 5:
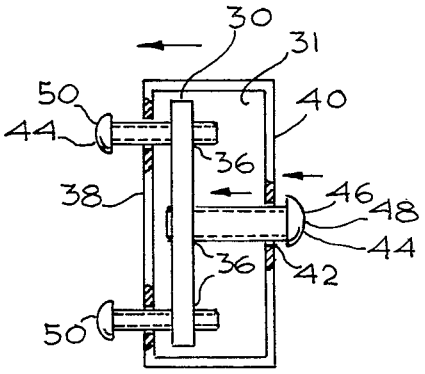
FIG. 5 is an enlarged fragmentary cross section of the bracket-adjusting and locking means of FIG. 4 in an unlocked intermediate position.
Figure 6:
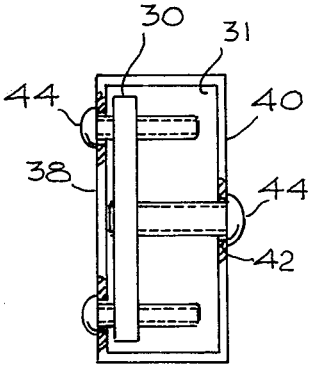
FIG. 6 is an enlarged fragmentary cross section of the bracket-adjusting and locking means of FIG. 2 in a second locked position.
Figure 7:
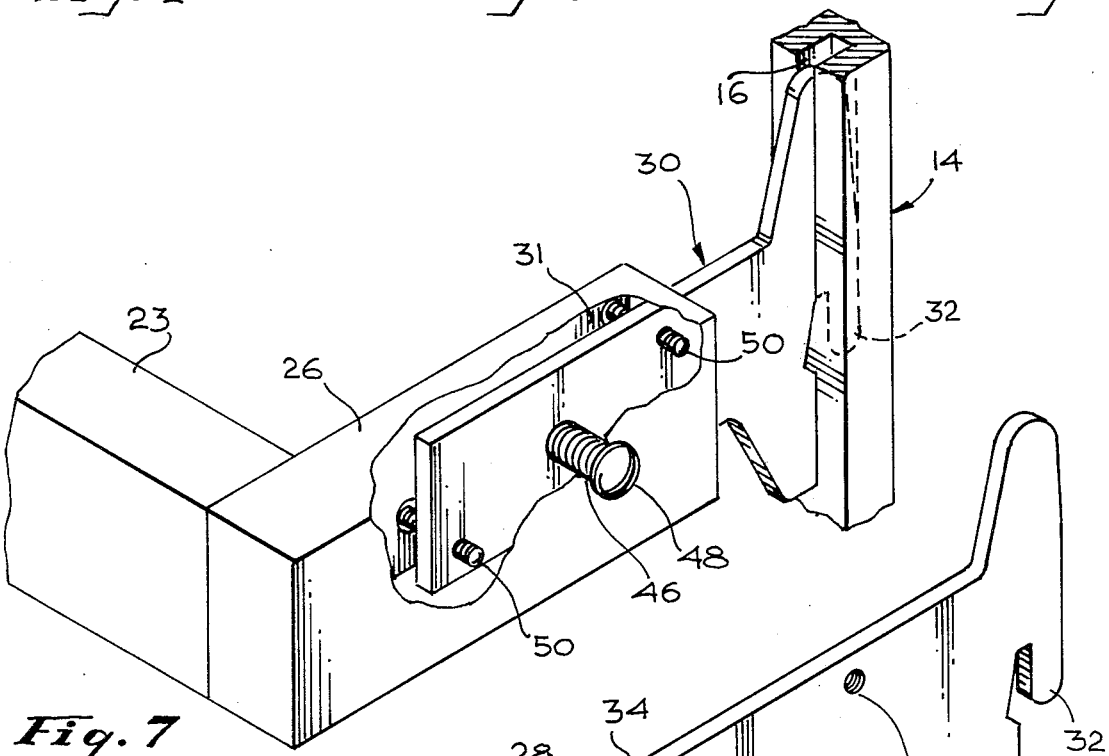
FIG. 7 is an enlarged fragmentary schematic perspective view of the bracket, extension and strip components of the embodiment of FIG. 1 in the assembled position; and, FIG. 8 is an enlarged fragmentary schematic perspective view of the bracket and extension components of FIG. 7 in the disassembled position.
Figure 8:
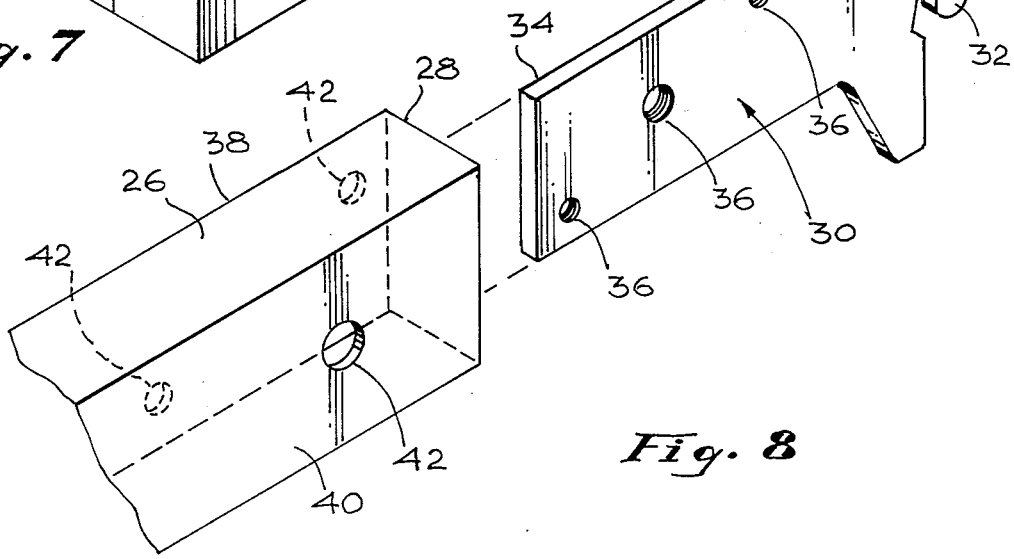

Details of the configuration of each bracket 30, holes 36, openings 42 and bolts 44 are set forth in FIGS. 4, 5, 6, 7 and 8. Thus, it will be seen from FIGS. 4, 5 and 6 that none of bolts 44 need extend through both sidewalls 38 and 40. Bolts 44 act to easily lock bracket 30 in place, yet bolts 44 can be easily loosened so that bracket 30 can be easily repositioned, as desired, within interior 31 of extension 24 or 26. FIG. 4 shows bracket 30 locked in a first position within interior 31. When it is desired to relocate bracket 30 in interior 31, as for example, by shifting it to the left in order to bring it into alignment with strip 12 or 14, bolt 46 adjacent sidewall 40 is loosened and unscrewed a desired distance out from sidewall 40 (FIG. 4). The head 48 of bolt 46 can then be pushed toward sidewall 40 until flush with the outside of sidewall 40 (FIG. 5). This moves bracket 30 to the left within interior 31 and causes bolts 50 to protrude from sidewall 38. This procedure is followed until bracket 30 is aligned with aperture 16. Then when bolts 50 are screwed toward sidewall 38 until they are tight thereagainst, plate 30 will be locked in place in the desired new position keeping it aligned with aperture 16. Since strips 12 and 14 may not be completely parallel, if and when it is desired to move bar 33 to a new level, one or both brackets 30 may need to be repositioned utilizing the above-described bracket-adjusting means in order to have their center to center spacing match that of the pair of apertures 16 at the new level on strips 12 and 14. The present invention makes such an adjustment simple, rapid and easy.

FIG. 3

Figure 3:
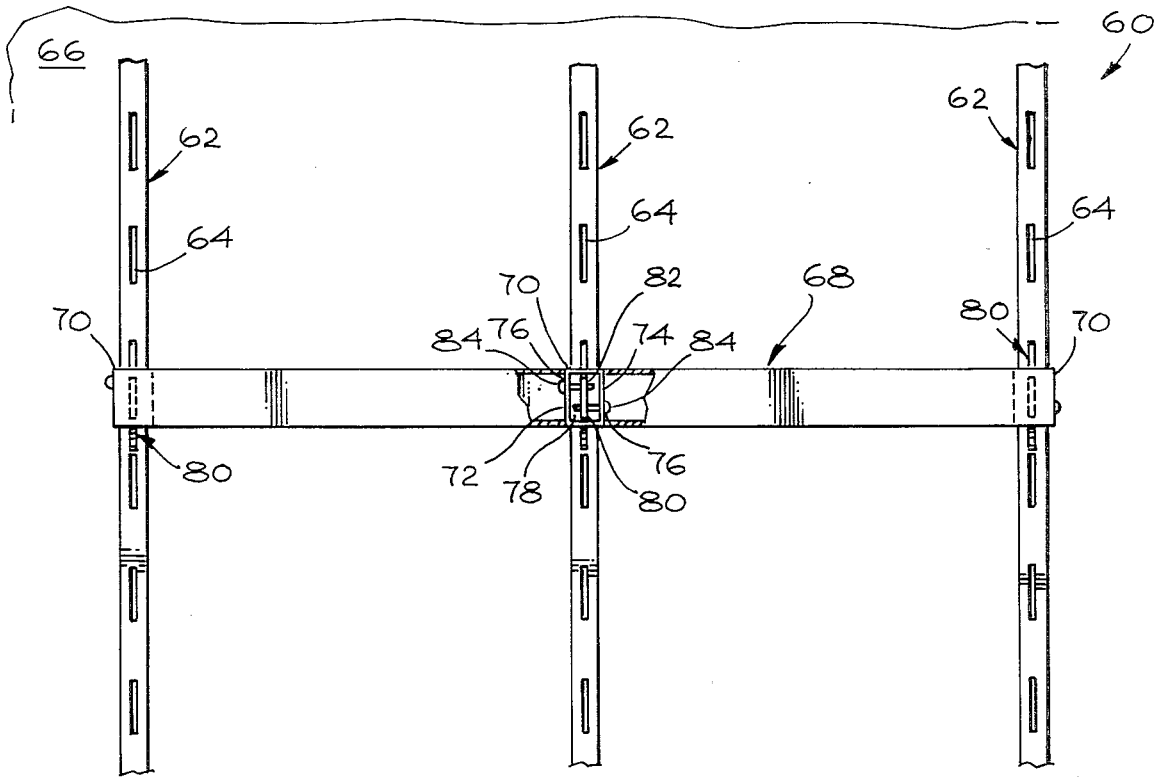
FIG. 3 is a schematic front elevation, partly broken away, of a second preferred embodiment of the improved wall bracket assembly of the present invention.

A second preferred embodiment of the improved wall bracket assembly of the present invention is schematically depicted in FIG. 3. Thus, assembly 60 is shown in schematic front elevation. Assembly 60 comprises three spaced generally vertical locator strips 62, each bearing vertically spaced apertures 64 therein and means (not shown) attaching strips 62 to a wall 66. Assembly 60 also includes a generally horizontal shelf 68 spanning all of strips 62 and containing three hollow rearwardly extending horizontal extensions 70 having open rear ends (not shown). Extensions 70 are generally rectangular in vertical section, and each have spaced sidewalls 72 and 74, each sidewall containing two spaced apertures 76 aligned horizontally behind each other. Thus, extensions 70 are similar to extensions 24 and 26, except for the number of extensions and the number of apertures therein. Contained within the interior 78 of each extension 70 is a bracket 80 identical with bracket 30 except that bracket 80 has two pairs of threaded holes 82 therein, alignable with the previously described apertures 76. Threaded bolts 84 pass freely through openings 76 and are threadably received in holes 82 to locate and lock bracket 80 in place. Each bracket 80 is releasably connected to the next adjacent aligned strip 62 by a rear hook (not shown) substantially identical to hook 32. Accordingly, assembly 60 is similar in construction and advantages to assembly 10. Each assembly 10 and 60 can be inexpensively fabricated of metal, plastic, wood and similar conventional materials to provide durable products.

It will be understood that strips of each assembly 10 and 60 may be in any desired orientation, for example, horizontal instead of vertical, and with the cross-member (bar, rack, shelf or the like) of the assembly at right angles thereto. It will also be understood that at least one bolt must extend through each extension sidewall in order to provide to desired adjustability, but that in order to effect maximum stability, alignability and ease of operation, at least two bolts should extend through at least one of the extension sidewalls, for a total of three or more bolts per extension. Various other modifications, changes, alterations and additions can be made. All such modifications, changes, alterations and additions as are within the scope of the appended claims form part of the present invention.

What is claimed is:

1. An improved wall bracket assembly, said assembly comprising, in combination:

a. a plurality of spaced generally parallel locator strips, each strip having spaced bracket-receiving means disposed along the length thereof;

b. a cross support spanning said strips and having a plurality of bracket-receiving hollow rear extensions, each said extension being disposed adjacent a separate one of said strips and including a pair of spaced side walls;

c. a plurality of brackets, the front end of each said bracket being releasably disposed in a different one of said extensions and having a rear end extending rearwardly thereof and releasably connected to a separate one of said strips through a separate one of said bracket-receiving means;

d. said front end of each bracket having a thickness significantly less than the distance between the inside of said spaced side walls of said extensions; and e. bracket-adjusting and locking means comprising:

(i) a plurality of spaced holes in the front end of each said bracket within said extension, (ii) a plurality of openings in each of said sidewalls of said extensions matching said bracket holes and adapted to be aligned therewith, and (iii) a plurality of bolts received through said sidewall openings and adjustable engaging said bracket through said bracket holes, whereby the spacing of said front end of each said bracket within said extension and thereby the alignment of each said bracket with each said strip is readily adjustable and lockable by manipulation of said bolts.

2. The improved bracket assembly of claim 1 wherein each said bracket hole is threaded, wherein each said bolt is threaded and wherein said bolts are slideably received through said sidewall openings and screwed through said bracket holes.

3. The improved bracket assembly of claim 2 wherein one of said sidewalls of each said extension has at least a spaced pair of said openings out of alignment with the remainer of said openings, and werein said bracket front end has at least three threaded spaced holes simultaneously alignable with all of said openings.

4. The improved bracket assembly of claim 3 wherein said cross support comprises a bar and wherein at least two of said extensions are disposed at opposite ends of said bar.

5. The improved bracket assembly of claim 4 wherein said bracket-receiving means comprise openings and wherein said rear end of each bracket includes a hook releasably disposed in one of said strip openings.

6. The improved bracket assembly of claim 5 wherein said locator strips are generally vertical and wherein said cross bar is generally horizontal.

7. The improved bracket assembly of claim 6 wherein said extensions are generally rectangular and wherein said brackets are generally vertical plates.

8. The improved bracket assembly of claim 3 wherein said cross support comprises a shelf and wherein there are at least three each of said extensions, locator strips and brackets.

* * * * *